US006767414B2

(12) United States Patent
Uehara et al.

(10) Patent No.: US 6,767,414 B2
(45) Date of Patent: Jul. 27, 2004

(54) MARAGING STEEL HAVING HIGH FATIGUE STRENGTH AND MARAGING STEEL STRIP MADE OF SAME

(75) Inventors: Toshihiro Uehara, Yonago (JP); Etsuo Fujita, Yagugi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 09/739,387

(22) Filed: Dec. 19, 2000

(65) Prior Publication Data

US 2001/0006081 A1 Jul. 5, 2001

(30) Foreign Application Priority Data

Dec. 24, 1999 (JP) ..... 11-367997

(51) Int. Cl.[7] ..... C23C 8/26

(52) U.S. Cl. ..... 148/318; 148/336; 420/94; 420/95; 420/96; 420/97; 420/98

(58) Field of Search ..... 148/318, 336; 420/94, 95, 96, 97, 98

(56) References Cited

U.S. PATENT DOCUMENTS

| | | | | |
|---|---|---|---|---|
| 4,443,254 A | | 4/1984 | Floreen | 75/123 B |
| 4,579,590 A | | 4/1986 | Asayama et al. | 75/128 T |
| 4,832,909 A | | 5/1989 | Schmidt et al. | 420/95 |
| 5,538,683 A | | 7/1996 | Pinnow et al. | 419/49 |
| 5,888,848 A | * | 3/1999 | Cozar et al. | 438/123 |
| 6,080,359 A | | 6/2000 | Davidson | 420/96 |

FOREIGN PATENT DOCUMENTS

| | | | | |
|---|---|---|---|---|
| EP | 1 176 224 A | | 1/2002 | |
| FR | 2 685 707 | | 12/1991 | C22C/38/08 |
| JP | 62080225 | * | 4/1987 | |
| JP | 63026345 | * | 2/1988 | |
| JP | 1-142021 | | 6/1989 | C21D/8/00 |
| JP | 1-142052 | | 6/1989 | C22C/38/12 |
| JP | 02-285053 A | | 11/1990 | |
| JP | 92-63907 | * | 10/1997 | |
| JP | 10-152759 | | 6/1998 | C22C/38/00 |
| JP | 11-264054 | | 9/1999 | C22C/38/00 |
| JP | 2000345302 A | | 12/2000 | |
| JP | 2001131710 A | | 5/2001 | |
| SU | 551404 | * | 3/1997 | |

OTHER PUBLICATIONS

Whitaker, B.W. Iron–12 Nickel–4 Cobalt–2 Molybdenum–0.05 Titanium Alloy for Use at 77. Degree K and Below, From: Nucl. Sci. Abstr. 1976, 33(3), Abstr. No. 5965, 1975.*

European Search Report (Jun. 7, 2002) for EP 00127544.

* cited by examiner

*Primary Examiner*—Sikyin Ip
(74) *Attorney, Agent, or Firm*—Sughrue Mion, PLLC

(57) ABSTRACT

There is provided inexpensive maraging steel having high fatigue strength and maraging steel strip formed by use of the same. The maraging steel having high fatigue strength, consisting essentially, by mass, of not more than 0.008% C, from 0 inclusive but not more than 2.0% Si, from 0 inclusive but not more than 3.0% Mn, not more than 0.010% P, not more than 0.005% S, 12 to 22% Ni, 3.0 to 7.0% Mo, less than 7.0% Co, not more than 0.1% Ti, not more than 2.0% Al, less than 0.005% N, not more than 0.0033% O (oxygen), and the balance substantially Fe, a total amount of (3Si+1.8Mn+Co/3+Mo+2.6Ti+4Al) being in a range of 8.0 to 13.0%.

28 Claims, No Drawings

MARAGING STEEL HAVING HIGH FATIGUE STRENGTH AND MARAGING STEEL STRIP MADE OF SAME

BACKGROUND OF THE INVENTION

The invention relates to maraging steel having high fatigue strength which is suitably used for members, which are required to have high fatigue strength, such as a power transmission belt etc. used in a continuously variable transmission of an automobile etc., and maraging steel strip formed of the maraging steel.

Hitherto, since conventional maraging steel has very high tensile strength of about 2000 MPa, it is used for forming members, which are required to have high strength, such as members for rockets, members for a centrifugal separator, members for aircraft, members for a continuously variable transmission of an automobile engine, dies and etc. The representative composition of the maraging steel is, , for example, 18% Ni-8% Co-5% Mo-0.4% Ti-0.1% Al-bal. Fe. The maraging steel contains, as strengthening elements, appropriate amount of each of Mo and Ti, so that the maraging steel can obtain high strength which is achieved by such an aging treatment as to precipitate intermetallic compounds such as $Ni_3Mo$, $Ni_3Ti$, $Fe_2Mo$ etc.

In the conventional maraging steel, a very high tensile strength can be obtained, however, the fatigue strength thereof is not necessarily high. In general, fatigue strength has such a tendency as to be raised in proportion to the increase of the hardness and tensile strength, however, in a high strength material having hardness not less than about 400 Hv and tensile strength not less than about 1200 MPa, the fatigue strength does not increase even in a case where both of the hardness and the tensile strength increase. This is also applicable to the conventional maraging steel. Thus, there has been desired a novel maraging steel in which a higher fatigue strength can be obtained.

Further, since the conventional maraging steel usually contains a large amount of Co which is an expensive element, it becomes very expensive, and new maraging steel low in price has been desired.

SUMMARY OF THE INVENTION

The object of the invention is to provide new maraging steel having high fatigue strength which is low in production cost, and to provide maraging steel strip made of the new maraging steel.

In conventional high strength steel such as the conventional maraging steel explained above, it is known that the fatigue fracture is initiated by cracks occurring in and propagating from the surface thereof in a case where the fatigue fracture occurs in a low cycle range, as disclosed in Japan Mechanical Society Theses Vol. A64, pages 2536 to 2541. Further, it is also known that, in another case of a very high cycle range exceeding $10^7$ cycles which is deemed to be the fatigue limit, the fatigue fracture of the steel is not initiated from the surface thereof but is initiated from inclusions included in the steel.

In the course of researching new maraging steel, the inventors of the invention have noticed such basic, technical concept as fatigue strength relating to the fatigue fracture initiated from the surface of the steel can be improved by providing compressive residual stress in the surface and as fatigue strength relating to the fatigue fracture initiated from the interior of the steel can be improved by making the inclusions fine in size.

As the result of further intensive research for obtaining new maraging steel hitherto desired, the inventors of the invention have found out that, in order to enhance the fatigue strength relating to the fatigue fracture initiated from the surface of the steel, it is effective to perform proper nitriding so that large, compressive residual stress may occur in the surface of the steel.

Further, as the results of the detailed research regarding the initiation of the fatigue fracture occurring from the interior of the conventional maraging steel, the inventors of the invention have found out that the fatigue fracture is initiated from inclusions and that the inclusions are TiN (or Ti(C, N)), so that it is noticed that non-existence of TiN (or Ti(C, N)) in the steel is effective to enhance the fatigue strength. In order to make TiN non-existent, it is effective to reduce Ti or N (nitrogen), however, extreme decrease of N is difficult insofar as melting apparatus of mass production is concerned, and causes such a problem as the production cost is raised greatly.

On the other hand, it is deemed that, by greatly reducing the amount of Ti, it becomes possible to reduce TiN and to make TiN fine in grain size. However, Ti is one of the important strengthening elements of the maraging steel, and the strength thereof is greatly lowered in a case where the amount of Ti is simply reduced. This maraging steel in which the content of Ti is reduced is disclosed in each of JP-A-10-152759 entitled "Maraging Steel Superior in Toughness" and JP-A-1-142052 entitled "Seamless Metallic Belt and Production Method of Same".

In the maraging steel of JP-A-10-152759, however, N (nitrogen) in the range of 0.005 to 0.03% is rather added positively. In the seamless, metallic belt of JP-A-1-142052, the content of Co is in the range of 8 to 15% which is in the same level as that of conventional maraging steel containing Ti, so that the production cost thereof is high unfavorably.

The inventors of the invention have fount out the first technical matter that, in new maraging steel in which the amount of each of Ti and N contained therein is restrained to be in a low level and in which the amount of Co contained therein is made to be in a low level for making the production cost thereof low, the decrease in tensile strength due to the lowering of the amount of each of Ti and Co can be compensated by adding a small amount of each of Si, Mn, Al and etc. under such a condition as to limit the value of (3Si+1.8Mn+Co/3+Mo+2.6Ti+4Al) to be in an appropriate range. Further, the inventors of the invention have further found out the second technical matter that, by simultaneously adding both of a small amount of B (boron) and an appropriate amount of Nb, Ta, and/or W, it becomes possible to make the prior austenite grains of the low Ti, low Co maraging steel fine in size which steel contains Si, Mn, Mo and etc., which is effective to enhance the tensile strength and the fatigue strength thereof.

In addition, the inventors have found out the third technical matter that, although the amount of Ti does not cause large influence on the surface hardness measured after the nitriding, the absolute value of surface compressive residual stress becomes large when the amount of Ti is in a low level. Furthermore, the inventors have found out the fourth technical matter that, by adding an appropriate amount of Cr, it becomes possible to increase the absolute value of the surface compressive residual stress occurring through the nitriding. By combining these technical matters, the inventor succeeded in achieving the invention.

Namely, according to the first aspect of the invention, there is provided a maraging steel having high fatigue strength, characterized by consisting, by mass, of not more than 0.008% C, from 0 inclusive but not more than 2.0% Si, from 0 inclusive but not more than 3.0% Mn, not more than 0.010% P, not more than 0.005% S, 12 to 22% Ni, 3.0 to 7.0% Mo, less than 7.0% Co, not more than 0.1% Ti, not more than 2.0% Al, less than 0.005% N (nitrogen), not more than 0.003% O (oxygen), and the balance substantially Fe, the total amount of 3Si+1.8Mn+Co/3+Mo+2.6Ti+4Al being in a range of 8.0 to 13.0%.

According to the second aspect of the invention, there is provided a maraging steel having high fatigue strength, characterized by consisting, by mass, of not more than 0.008% C, from 0 inclusive but not more than 1.0% Si, from 0 inclusive but not more than 2.0% Mn, not more than 0.010% P, not more than 0.005% S, 12 to 22% Ni, 3.0 to 7.0% Mo, less than 7.0% Co, not more than 0.05% Ti, not more than 2.0% Al, less than 0.005% N (nitrogen), not more than 0.003% O (oxygen), and the balance substantially Fe, the total amount of 3Si+1.8Mn+Co/3+Mo+2.6Ti+4Al being in a range of 8.0 to 13.0%.

According to the third aspect of the invention, there is provided a maraging steel according to any one of the first and second aspects of the invention, further containing not more than 4 mass % Cr. According to the fourth aspect of the invention, there is provided a maraging steel according to any one of the first to third aspects of the invention, characterized by further containing not more than 0.01 mass % B. According to the fifth aspect of the invention, there is provided a maraging steel according to any one of the first to fourth aspects of the invention, characterized by further containing, by mass, at least one kind selected from the group consisting of not more than 1.0% Nb, not more than 2.0% Ta, and not more than 2.0% W. According to the sixth aspect of the invention, there is provided a maraging steel according to any one of the first to fifth aspects of the invention, characterized by further containing, by mass, at least one kind not more than 0.5% in total selected from the group consisting of Nb, Ta, and W.

Further, the maraging steel according to any one of the first to sixth aspect of the invention may be formed so that it has such prior austenite grains fine in size as to be not less than 9 in ASTM number, which is the seventh aspect of the invention. Furthermore, the maraging steel strip made of the maraging steel according to any one of the first to seventh aspect of the invention may be provided with a nitride layer formed on a surface portion thereof so that it has compressive residual stress on the surface thereof, which is the eighth aspect of the invention.

DESCRIPTION OF THE PREFERRED EMBODIMENTS OF THE INVENTION

The invention is achieved on the basis of the first to fourth technical matters found out by the inventors, and the function of each of the elements contained in the maraging steel of the invention is described below.

C (carbon) acts, together with Ti and Mo, to form carbides and carbo-nitrides to thereby reduce the amount of precipitated intermetallic compounds effective to enhance the strength. Thus, the amount of C is restricted to be in a low level. In view of this, the amount of C is limited to be not more than 0.008%.

Si is an optional element contributing to the enhancement of the strength because it makes intermetallic compounds fine in size which are precipitated during the aging treatment and because it reacts with Ni to thereby form the intermetallic compounds. Thus, Si may be added to compensate for the decrease in strength caused by the reducing of the amount of Ti and Co. However, Si added in excess of 2.0% makes the toughness and the ductility deteriorated. Thus, the amount of Si is limited to be from 0 inclusive but not more than 2.0, and preferably to be from 0 inclusive but not more than 1.0%. Further, is a case of adding Si, since there occurs such a tendency as non-resolved intermetallic compounds are apt to remain, it becomes necessary to somewhat raise the temperature of the solution heat treatment, so that the strength can be sufficiently maintained because of the other strengthening elements. In addition, in a case where it is impossible to raise the solution heat treatment, no Si may be added.

Since Mn (manganese) is an optional element which acts to form the intermetallic compound together with Ni to thereby contribute to the age hardening, Mn may be added to compensate for the decrease in strength caused due to the reducing of the amount of Ti and Co. However, Mn added in excess of 3.0% makes the toughness and ductility lowered. Thus, the amount of Mn is limited to be from 0 inclusive but not more than 3.0% and preferably to be from 0 inclusive but not more than 2.0%. Further, the strengthening function of Mn is relatively small in comparison with the adding amount thereof, and it is necessary to add much amount of Mn in order to obtain large enhancement of strength, that is, Mn is not a necessarily optimal element when it is used to enhance the strength. Thus, when the strength can be maintained by the other strengthening elements, no Mn may be added.

P (phosphorous) and S (sulfur) are impurities, which P and S are segregated at the prior austenite grain boundary and which P and S form inclusions, so that P and S cause the embrittlement of the maraging steel and make the fatigue strength lowered. Thus, the amounts of P and S are limited to be not more than 0.01% and not more than 0.005%, respectively.

Since Ni (nickel) acts to form the martensite structure of low carbon which structure is the matrix of the maraging steel, the amount of Ni is required to be at least 12%. However, Ni in excess of 22% makes the austenite structure stable to thereby make the occurrence of the martensite transformation hard. Thus, the amount of Ni is limited to be in the range of 12 to 22%.

Mo (molybdenum) is an important element which forms the intermetallic compounds fine in size such as $Ni_3Mo$, $Fe_2Mo$ and etc. during the aging treatment to thereby contribute to the precipitation strengthening. Further, Mo is effective to enlarge both of the hardness of the surface and the compressive residual stress by the nitriding. Mo less than 3.0% makes the enlargement of tensile strength insufficient, however, Mo more than 7.0% becomes apt to form intermetallic compounds coarse in size which contain Fe and Mo as the main constituents thereof. Thus, the amount of Mo is limited to be in the range of 3.0 to 7.0%.

Co (cobalt) is an important element which lowers the solid solubility of Mo in the temperature range of aging precipitation to thereby promote the precipitation of the Mo-containing intermetallic compounds fine in size which contribute to the aging strengthening. Thus, it is preferred for much amount of Co to be added, in view of the attainment of the sufficient strength and toughness, and Co of 8 to 13% is usually contained in the conventional maraging steel. On the other hand, since Co is an expensive element, a low amount thereof is preferred in view of economics. In the invention, by substituting the above-disclosed, raised amounts of strengthening elements for a part of Co, it becomes possible to restrict the content of Co to the range less than 7.0%.

Ti (titanium) is an important element insofar as the conventional maraging steel is concerned. However, in the invention, since Ti is an unfavorable element which forms the inclusions of TiN and/or Ti(C, N) due to which the fatigue strength is lowered particularly in the very high cycle range, Ti is deemed to be one of impurities and is restricted to a low level.

Further, Ti is apt to form a stable oxide film thin in thickness on the surface, which oxide film acts to impede the nitriding with the result that it becomes difficult to obtain sufficient, compressive residual stress occurring on the nitrided surface. In the invention, for readily performing the nitriding and for enlarging the surface compressive residual stress obtained after the nitriding, Ti is one of unfavorable impurities and is required to be in the low level.

Ti more than 0.1% makes the reducing of TiN and/or Ti(C, N) insufficient and are apt to form the above-explained unfavorable, stable oxide film, Ti is limited to be not more than 0.1%, preferably to be not more than 0.05%, and most preferably to be not more than 0.01%.

Al (aluminum) is an element usually used for deoxidation and is usually contained by a slight amount in the conventional maraging steel, which Al not only forms the intermetallic compounds together with Ni to thereby contribute to the strengthening but also is effective to raise the surface hardness and compressive residual stress after the nitriding. In the invention, Al is added for compensating for the lowering of the strength which lowering is caused by the decrease in the amount of Ti and Co. However, since Al more than 2.0% causes much amount of $Al_2O_3$ inclusion to thereby deteriorate the fatigue strength and since it forms the thin, stable oxide film on the surface to thereby impede the nitriding, the amount of Al is limited to be not more than 2.0%. However, in a case where the maraging steel of the invention can have sufficiently high strength by additives other than Al or where it is particularly wanted to lower the amount of the $Al_2O_3$ inclusion, Al may be limited to be not more than 0.2% which is necessary for the deoxidation.

Each of Co, Mo and Ti is one of the main strengthening elements contained in the conventional maraging steel. The inventors of the invention have found out that each of Si, Mn and Al are also elements contributing to the age strengthening of the maraging steel, that, in a case of lowering the amount of each of Ti and Co, it is necessary to compensate for the decrease in strength (due to the lowered amount of Ti and Co) by increasing the amount of Si, Mn, Mo and Al, and that the contribution of the elements to the strengthening is not equivalent but the strengthening rates of Si, Mn, Co, Ti and Al are 3, 1.8, ⅓, 2.6, and 4 times the strengthening rate of Mo, respectively.

Thus, the contribution regarding the strengthening brought about by Si, Mn, Co, Mo, Ti and Al can be expressed by the following formula:

$$3Si+1.8Mn+Co/3+Mo+2.6Ti+4Al.$$

When the value of the mass percent of this formula is less than 8%, the strength becomes insufficient. On the other hand, when it exceeds 13.0%, there occurs such a fear as the toughness is deteriorated although the strength is raised very much. Thus, the value of (3Si+1.8Mn+Co/3+Mo+2.6Ti+4Al) is limited to be in the range of 8.0 to 13.0%.

N (nitrogen) is an unfavorable impurity element which forms, by combining with Ti, the inclusions of TiN and/or Ti(C, N) to thereby lower particularly the fatigue strength in the very high cycle range. In the conventional maraging steel containing Ti, it is necessary to lower the amount of N at a greatly low level. However, in the maraging steel of the invention in which the amount of Ti is reduced to the very low level, since the amount of N which comes to be contained during usual vacuum melting does not substantially cause any bad influence, it is limited to be less than 0.005%, preferably to be not more than 0.004, and most preferably to be not more than 0.002%.

O (oxygen) is an impurity element which forms oxide inclusions to thereby lower the toughness and the fatigue strength. Thus, O is limited to be not more than 0.003%.

Cr (chromium) has large affinity for N when the nitriding is performed, so that N makes the depth of the nitride layer small, raises the hardness of the nitride layer, and increases the compressive residual stress occurring in the nitrided surface portion. Cr added in excess of 4.0% can bring about no further enhancement of the above-explained advantage and greatly lowers the strength after aging. Thus, Cr is limited to be not more than 4.0%, and preferably to be not more than 2.0%.

B (boron) is an element which makes the prior austenite grains, which had existed in the state corresponding to the solution heat treatment performed after the cold working, fine in size to thereby contribute to the enhancement of the strengthening together with the effect of restraining the roughness of the surface. Thus, B may be added as occasion demands. Since B more than 0.01% lowers the toughness, B is limited to be not more than 0.01%.

Each of Nb, Ta, and W forms compounds fine in size together with B, C and N to thereby makes the prior austenite grains, which had existed in the state corresponding to the solution heat treatment performed after the cold working, fine in size, whereby it contributes to the strengthening and restrains the surface from becoming rough in roughness, and the effect thereof becomes large when it is added together with B. In comparison with the adding of B alone, the adding of B together with Nb, Ta, and/or W can keep prior austenite grains fine in size up to the higher temperature of the solution heat treatment. Thus, since it can make the temperature of the solution heat treatment higher without causing coarse grains, it can make the precipitation-strengthening elements dissolved sufficiently at the high temperature when the solution heat treatment is performed, to thereby bring about sufficient age hardening during the aging treatment performed thereafter.

Since Nb added in excess of 1.0% lowers the toughness and since each of Ta and W added in excess of 2.0% lowers the toughness, Nb and each of Ta and W are limited to be not more than 1.0% and to be not more than 2.0%, respectively.

Preferably, Nb and each of Ta and W are limited to be not more than 0.5% and to be not more than 1.0%, and most preferably at least one kind selected from the group consisting of Nb, Ta, and W is limited to be not more than 0.5% in total.

In the maraging steel of the invention, it is possible to make the prior austenite grains, which had existed in the state corresponding to the solution heat treatment performed after the cold working, fine in size to the degree not less than ASTM No. 9 by the steps of cold working at a reduction of area not less than 10%, and performing solution heat treatment at a temperature, for example, of 800 to 1000° C. which is appropriate in taking the composition into consideration. Incidentally, in the maraging steel, the grains or the crystal grains means austenite grains having existed when it was subjected to the solution heat treatment. In the maraging steel of the invention, by making the grains fine in size, there are expected such advantages as to stably raise each of the hardness, tensile strength, fatigue strength, and impact toughness etc. and as to reduce the degree of the surface roughness in the case of the steel strip.

In the maraging steel of the invention, since Ti contained therein which forms the stable oxide film apt to impede the nitriding is restrained to the very low level, there can be performed various nitriding treatments such as gas nitriding, gas carbonitriding, sulfonitriding, plasma nitriding, salt bath nitriding and etc.

Further, by use of the maraging steel conditioned to have the chemical composition limited in the invention, it is possible to form a strip and then to nitride the strip under an appropriate conditions so that it is, for example, usable for the parts of the continuously variable transmission of an automobile engine, in which nitrided strip can be formed a thin nitride layer having a thickness of 20 to 40 $\mu$m substantially without forming any compound layer while affording large, compressive residual stress in the surface portion thereof, whereby it becomes possible to obtain sufficiently high fatigue strength. Incidentally, as regards the compressive residual stress occurring in the surface portion, it is preferred that the maraging steel has the compressive residual stress raised as much as possible, and the controlling thereof can be performed by varying the thickness of the nitride layer.

The maraging steels of the invention and comparative steels were melted by use of a vacuum induction melting furnace, and an ingot of 10 kg was made regarding each of the steels, which ingots were subjected to hot forging. Further, by use of the ingots, steel strips each having a thickness of about 0.3 mm were formed by performing the hot rolling and cold rolling of the ingots. After that, the solution heat treatment thereof was performed at an appropriate temperature of 825 to 960° C., the aging treatment being then performed at 490° C., and the gas carbonitriding was performed at a temperature of 450 to 470° C. so that each of the steel strips was provided with a nitride layer having a thickness of 20 to 40 $\mu$m.

In Table 1, the chemical compositions are disclosed regarding the steel Nos. 1 to 19 embodying the invention and the comparative steel Nos. 21 to 24. Further, in Table 2 are disclosed the size of the austenite grains which had existed when each of the steel samples was subjected to the aging treatment, the hardness of the interior thereof, the surface hardness after the nitriding treatment, and the residual stress occurring in the surface portion after the nitriding treatment. In Table 2, the marks "+" and "−" regarding the residual stress mean "tensile residual stress" and "compressive residual stress", respectively, and in all of the steel examples the compressive, residual stress occurred.

On the cross section of each of the steel examples of the invention and the comparative steel examples, the fine inclusions were observed and analyzed by use of electron microscope and X-ray analyzing device, so that it was confirmed that, in all of the steel example with the exception of the comparative steel No. 22, the amount of the inclusions of TiN and/or Ti(C, N) was in a very low level.

TABLE 1

(mass %)

| Steel No. | C | Si | Mn | P | S | Ni | Cr | Mo | Co | Ti | Al | N | O | B | Nb | Ta | W | Fe | 3Si + 1.8Mn + CO/3 + Mo + 2.6Ti + 4Al | Remarks |
|---|---|---|---|---|---|---|---|---|---|---|---|---|---|---|---|---|---|---|---|---|
| 1 | 0.005 | 0.31 | 0.02 | 0.002 | 0.001 | 18.3 | *— | 5.4 | 6.9 | 0.007 | 0.11 | 0.0010 | 0.0009 | 0.0008 | — | — | — | bal. | 9.1 | Steel of the invention |
| 2 | 0.006 | 0.01 | 1.47 | 0.003 | 0.001 | 18.5 | — | 5.1 | 5.2 | 0.012 | 0.12 | 0.0013 | 0.0008 | 0.0013 | — | — | — | bal. | 10.0 | " |
| 3 | 0.004 | 0.24 | 0.86 | 0.002 | 0.001 | 18.6 | — | 5.2 | 5.1 | 0.009 | 0.10 | 0.0007 | 0.0006 | 0.0011 | — | — | — | bal. | 9.6 | " |
| 4 | 0.006 | 0.59 | 0.46 | 0.003 | 0.002 | 18.5 | — | 5.0 | 4.9 | 0.016 | 0.11 | 0.0017 | 0.0007 | 0.0009 | — | — | — | bal. | 9.7 | " |
| 5 | 0.005 | 0.97 | 0.01 | 0.002 | 0.002 | 18.4 | — | 5.3 | 5.1 | 0.011 | 0.09 | 0.0009 | 0.0008 | 0.0008 | — | — | — | bal. | 10.3 | " |
| 6 | 0.007 | 0.03 | 0.02 | 0.002 | 0.001 | 17.9 | — | 5.2 | 5.3 | 0.006 | 0.78 | 0.0015 | 0.0009 | 0.0012 | — | — | — | bal. | 10.2 | " |
| 7 | 0.005 | 0.36 | 0.02 | 0.003 | 0.001 | 18.5 | 1.1 | 5.6 | 6.4 | 0.005 | 0.12 | 0.0021 | 0.0009 | 0.0009 | — | — | — | bal. | 9.3 | " |
| 8 | 0.007 | 0.37 | 0.01 | 0.004 | 0.002 | 18.7 | 2.3 | 5.4 | 6.8 | 0.014 | 0.10 | 0.0019 | 0.0010 | 0.0013 | — | — | — | bal. | 9.2 | " |
| 9 | 0.005 | 0.39 | 0.01 | 0.001 | 0.001 | 18.4 | 1.0 | 5.5 | 5.1 | 0.005 | 0.10 | 0.0005 | 0.0012 | 0.0014 | — | — | — | bal. | 8.8 | " |
| 10 | 0.005 | 0.39 | 0.02 | 0.002 | 0.002 | 18.6 | 1.2 | 6.0 | 5.1 | 0.004 | 0.08 | 0.0015 | 0.0015 | 0.0006 | 0.042 | — | — | bal. | 9.2 | " |
| 11 | 0.004 | 0.53 | 0.14 | 0.002 | 0.001 | 18.3 | 0.9 | 5.7 | 4.8 | 0.006 | 0.09 | 0.0018 | 0.0021 | 0.0017 | 0.038 | 0.026 | — | bal. | 9.5 | " |
| 12 | 0.004 | 0.40 | 0.01 | 0.001 | 0.001 | 18.4 | 1.1 | 5.5 | 5.1 | 0.006 | 0.11 | 0.0005 | 0.0028 | 0.0011 | 0.058 | — | — | bal. | 8.9 | " |
| 13 | 0.006 | 0.39 | 0.02 | 0.002 | 0.002 | 18.6 | 1.0 | 5.5 | 5.1 | 0.004 | 0.08 | 0.0016 | 0.0017 | 0.0006 | 0.080 | — | — | bal. | 8.7 | " |
| 14 | 0.003 | 0.22 | 0.02 | 0.002 | 0.002 | 18.6 | 1.0 | 5.5 | 5.1 | 0.003 | 0.06 | 0.0020 | 0.0017 | 0.0007 | 0.914 | — | — | bal. | 8.2 | " |
| 15 | 0.004 | 0.39 | 0.02 | 0.002 | 0.002 | 18.7 | 1.0 | 5.5 | 5.0 | 0.004 | 0.08 | 0.0015 | 0.0014 | 0.0007 | 0.042 | — | 1.03 | bal. | 8.7 | " |
| 16 | 0.004 | 0.40 | 0.01 | 0.001 | 0.001 | 18.5 | 1.0 | 6.4 | 3.2 | 0.007 | 0.11 | 0.0005 | 0.0027 | 0.0012 | 0.059 | — | — | bal. | 9.2 | " |
| 17 | 0.003 | — | — | 0.002 | 0.001 | 18.9 | 1.1 | 5.1 | 4.9 | 0.008 | 0.57 | 0.0012 | 0.0014 | 0.0014 | 0.031 | — | — | bal. | 9.0 | " |
| 18 | 0.004 | — | — | 0.003 | 0.001 | 18.7 | 0.8 | 4.9 | 5.2 | 0.009 | 1.05 | 0.0009 | 0.0009 | 0.0013 | 0.027 | — | — | bal. | 10.9 | " |
| 19 | 0.004 | — | — | 0.002 | 0.001 | 18.8 | 0.9 | 4.8 | 4.8 | 0.007 | 1.54 | 0.0014 | 0.0007 | 0.0011 | 0.024 | — | — | bal. | 12.6 | " |
| 21 | 0.006 | 0.01 | 0.03 | 0.003 | 0.001 | 18.4 | — | 2.1 | 8.1 | 0.007 | 0.10 | 0.0016 | 0.0006 | — | — | — | — | bal. | 5.3 | Comparative steel |
| 22 | 0.005 | 0.02 | 0.02 | 0.005 | 0.002 | 18.6 | — | 7.8 | 9.3 | 0.550 | 0.09 | 0.0009 | 0.0009 | — | — | — | — | bal. | 12.8 | " |
| 23 | 0.008 | 0.02 | 0.02 | 0.001 | 0.001 | 18.2 | — | 9.3 | 13.7 | 0.003 | 0.12 | 0.0014 | 0.0014 | — | — | — | — | bal. | 14.5 | " |
| 24 | 0.004 | 0.03 | 0.01 | 0.002 | 0.001 | 18.9 | — | 5.1 | 5.3 | 0.010 | 0.13 | 0.0015 | 0.0012 | 0.0004 | — | — | — | bal. | 7.5 | " |

*The mark "—" means no addition.

TABLE 2

| Steel No. | temp. of solution heat treatment (° C.) | Temp. of aging treatment (° C.) | G.S. No. (ASTM No.) | Hardness of the interior (Hv) | Gas carbonitriding: Surface hardness (Hv) | Gas carbonitriding: Surface residual stress (MPa) | Remarks |
|---|---|---|---|---|---|---|---|
| 1 | 825 | 490 | 10 | 570 | 865 | −1301* | Steel of the invention |
| 2 | 825 | 490 | 10 | 612 | 901 | −1345 | " |
| 3 | 825 | 490 | 10 | 594 | 882 | −1359 | " |
| 4 | 825 | 490 | 9.5 | 604 | 873 | −1363 | " |
| 5 | 825 | 490 | 10 | 632 | 912 | −1340 | " |
| 6 | 825 | 490 | 10 | 617 | 908 | −1336 | " |
| 7 | 825 | 490 | 10 | 586 | 874 | −1315 | " |
| 8 | 825 | 490 | 10 | 578 | 868 | −1308 | " |
| 9 | 900 | 490 | 9.5 | 544 | 861 | −1379 | " |
| 10 | 940 | 490 | 9.5 | 556 | 875 | −1369 | " |
| 11 | 920 | 490 | 10 | 539 | 886 | −1373 | " |
| 12 | 920 | 490 | 10 | 541 | 863 | −1378 | " |
| 13 | 920 | 490 | 10.5 | 548 | 859 | −1383 | " |
| 14 | 960 | 490 | 12 | 538 | 839 | −1396 | " |
| 15 | 940 | 490 | 10 | 552 | 858 | −1385 | " |
| 16 | 940 | 490 | 11 | 535 | 881 | −1345 | " |
| 17 | 850 | 490 | 11 | 502 | 873 | −1375 | " |
| 18 | 850 | 490 | 11 | 536 | 918 | −1394 | " |
| 19 | 850 | 490 | 11 | 568 | 964 | −1417 | " |
| 21 | 825 | 490 | 8.5 | 381 | 731 | −1351 | Comparative steel |
| 22 | 940 | 490 | 7 | 745 | 943 | −948 | " |
| 23 | 960 | 490 | 8 | 813 | 1005 | −903 | " |
| 24 | 825 | 490 | 8.5 | 495 | 817 | −1134 | " |

*The mark "−" means compressive residual stress.

As apparent from Table 2, in each of the steel Nos. 1 to 19 embodying the invention, the interior hardness after the age hardening is not less than 500 HV (Vickers hardness number), that is, each of the steel Nos. 1 to 16 has strength sufficient as the maraging steel, and both of the high surface hardness and the large surface compressive residual stress occur because of the nitriding treatment. In each of the steel Nos. 17 to 19 embodying the invention, neither Si nor Mn is added while somewhat much amount of Al is added, whereby the value of 3Si+1.8Mn+Co/3+Mo+2.6Ti+4Al is adjusted to fall in the prescribed range. Also in this case, it becomes possible to obtain the high hardness of the inner portion after the aging, the high surface hardness after the nitriding, and the large compressive residual stress. Further, in each of the steel Nos. 10 to 19 embodying the invention in which at least one selected from the group consisting of Nb, Ta and W is added in addition to B, such grains fine in size as to be not less than ASTM No. 9 regarding the prior austenite grains defined above are obtained even in the case of such a high temperature of the solution heat treatment as to be not less than 850° C. On the other hand, in the comparative steel No. 21 having a Co amount higher than the range limited in the invention and the lower amount of Mo and the lower amount of (3Si+1.8Mn+Co/3+Mo+2.6Ti+4Al) than the ranges limited in the invention and in the comparative steel No. 24 having the lower amount of (3Si+1.8Mn+Co/3+Mo+2.6Ti+4Al), each of the interior hardnesses after the aging treatment and each of the surface hardnesses after the nitriding treatment is low in value, that is, the strength thereof is somewhat insufficient.

Further, in each of the comparative steel No. 23 having an amount higher than the range limited in the invention regarding each of Mo, Co, and (3Si+1.8Mn+Co/3+Mo+2.6Ti+4Al) and the comparative steel No. 22 having an amount higher than the range limited in the invention regarding each of Mo, Co and Ti, the compressive residual stress after the nitriding treatment is small, that is, it is hard to obtain large, compressive residual stress.

As disclosed above, since the maraging steel embodying the invention can have high strength, and both of the high hardness and the large, compressive residual stress on the surface portion thereof after the nitriding treatment, it becomes possible to bring about such an industrially remarkable advantage as to have a long fatigue service life when it is used for producing parts, which are required to have high fatigue strength, such as a power transmission belt used in a continuously variable transmission for automobile engines and etc.

What is claimed is:

1. A maraging steel strip having high fatigue strength, made from a maraging steel consisting essentially of, by mass, not more than 0.008% C, 0.01% to 2.0% Si, 0.01% to 3.0% Mn, not more than 0.010% P, not more than 0.005% S, 12 to 22% Ni, 3.0 to 7.0% Mo, not more than 6.9% Co, not more than 0.05% Ti, 0.06 to 2.0% Al, less than 0.005% N (nitrogen), not more than 0.003% O (oxygen), and the balance substantially Fe, a total amount of (3Si+1.8Mn+Co/3+Mo+2.6Ti+4Al) being in a range of 8.0 to 13.0%, wherein the maraging steel contains an intermetallic compound of NiAl, and has a hardness of not less than Hv 502 to not more than Hv 632.

2. A maraging steel strip having high fatigue strength according to claim 1, further containing not more than 4 mass % Cr.

3. A maraging steel strip having high fatigue strength according to claim 1, further containing not more than 0.01 mass % B.

4. A maraging steel strip having high fatigue strength according to claim 2, further containing not more than 0.01 mass % B.

5. A maraging steel strip having fatigue strength according to claim 4, further containing, by mass, at least one kind selected from the group consisting of not more than 1.0% Nb, not more than 2.0% Ta, and not more than 2.0% W.

6. A maraging steel strip having high fatigue strength according to claim 4, further containing, by mass, at least one kind not more than 0.5% in total selected from the group consisting of Nb, Ta, and W.

7. A maraging steel strip having high fatigue strength according to claim 1, wherein said steel has crystal grains fine in size which is not less than 9 in ASTM number.

8. A maraging steel strip according to claim 1, comprising a nitride layer formed on a surface portion of said maraging steel, and compressive residual stress in said surface portion.

9. A maraging steel strip according to claim 3, comprising a nitride layer formed on a surface portion of said maraging steel, and compressive residual stress in said surface portion.

10. A maraging steel strip according to claim 5, comprising a nitride layer formed on a surface portion of said maraging steel, and compressive residual stress in said surface portion.

11. A maraging steel strip having high fatigue strength, consisting essentially of, by mass, not more than 0.008% C, 0.01% to 1.0% Si, 0.01% to 2.0% Mn, not more than 0.010% P, not more than 0.005% S, 12 to 22% Ni, 3.0 to 7.0% Mo, not more than 6.9% Co, not more than 0.05% Ti, 0.06 to 2.0% Al, less than 0.005% N (nitrogen), not more than 0.003% O (oxygen), and the balance substantially Fe, a total amount of (3Si+1.8Mn+Co/3+Mo+2.6Ti+4A1) being in a range of 8.0 to 13.0%, wherein the maraging steel contains an intermetallic compound of NiAl, and has a hardness of not less than Hv 502 to not more than Hv 632.

12. A maraging steel strip having high fatigue strength according to claim 11, further containing not more than 4 mass % Cr.

13. A maraging steel strip having high fatigue strength according to claim 11, further containing not more than 0.01 mass % B.

14. A maraging steel strip having high fatigue strength according to claim 12, further containing not more than 0.01 mass % B.

15. A maraging steel strip having high fatigue strength according to claim 14, further containing, by mass, at least one kind selected from the group consisting of not more than 1.0% Nb, not more than 2.0% Ta, and not more than 2.0% W.

16. A maraging steel strip having high fatigue strength according to claim 14, further containing, by mass, at least one kind not more than 0.5% in total selected from the group containing of Nb, Ta, and W.

17. A maraging steel strip having high fatigue strength according to claim 11, wherein said steel has crystal grains fine in size which is not less than 9 in ASTM number.

18. A maraging steel strip according to claim 11, comprising a nitride layer formed on a surface portion of said maraging steel, and compressive residual stress in said surface portion.

19. A maraging steel strip according to claim 13, comprising a nitride layer formed on a surface portion of said maraging steel, and compressive residual stress in said surface portion.

20. A maraging steel strip according to claim 15, comprising a nitride layer formed on a surface portion of said maraging steel, and compressive residual stress in said surface portion.

21. A maraging steel strip having high fatigue strength according to claim 11, wherein the amount of Co is not less than 3.2%.

22. A maraging steel strip having high fatigue strength according to claim 1, wherein the amount of Co is not less than 3.2%.

23. A maraging steel strip according to claim 1, wherein the amount of Al is 0.57 to 2.0%.

24. A maraging steel strip according to claim 23, further containing not more than 4.0 mass % Cr.)

25. A maraging steel strip according to claim 24, further containing not more than 0.01 mass % B.

26. A maraging steel strip according to claim 25, further containing at least one element selected from the group consisting of not more than 1.0 mass % Nb, not more than 2.0 mass % Ta, and not more than 2.0% W.

27. A maraging steel strip according to claim 26, wherein the total amount of said at least one element is not more than 0.5 mass %.

28. A maraging steel strip having high fatigue strength, consisting essentially of, by mass, not more than 0.008% C, 0.01% to 1.0% Si, 0.01% to 3.0% Mn, not more than 0.010% P, not more than 0.005% S, 12 to 22% Ni, 3.0 to 7.0% Mo, not more than 6.9% Co, not more than 0.05% Ti, 0.06% to 2.0% Al, less than 0.005% N (nitrogen), not more than 0.003% O (oxygen), and the balance substantially Fe, wherein said maraging steel contains each of the elements Si, Mn, Go, Mo, and Al in an amount of (3Si +1.8Mn+Co/3+Mo+2.6Ti+4Al) being in a range of 8.0 to 13.0%, and an intermetallic compound of NiAl, and wherein the maraging steel has a hardness of from not less than Hv 502 to not more than Hv 632.

* * * * *